United States Patent [19]

Schuplin

[11] 4,191,352

[45] Mar. 4, 1980

[54] ROTATABLY INSTALLED SUSPENSION CLIP

[75] Inventor: Jerome T. Schuplin, Parma Heights, Ohio

[73] Assignee: Fastway Fasteners, Inc., Lorain, Ohio

[21] Appl. No.: 935,356

[22] Filed: Aug. 21, 1978

[51] Int. Cl.[2] ..... A44B 21/00; E04C 17/18

[52] U.S. Cl. ..... 248/317; 52/484

[58] Field of Search ..... 248/317, 340, 228, 226.5, 248/214; 52/484, 27, 28, 39; 24/73 BP, 73 HH

[56] References Cited

U.S. PATENT DOCUMENTS

| | | | |
|---|---|---|---|
| 2,868,490 | 1/1959 | Price | 248/228 |
| 3,003,735 | 10/1961 | Havener | 248/228 |
| 3,018,080 | 1/1962 | Loudon | 248/228 |
| 3,463,432 | 8/1969 | Ptak | 248/228 |
| 3,601,862 | 8/1971 | Hargadon | 248/317 X |
| 3,612,461 | 10/1971 | Brown | 52/484 X |
| 4,112,550 | 9/1978 | Dewitt | 248/228 X |

OTHER PUBLICATIONS

"Caddy Fasteners for the Construction Industry" published by Erico Products, Inc., 34600 Solon Rd., Cleveland, Ohio 44139 in 1973.

*Primary Examiner*—J. Franklin Foss

*Attorney, Agent, or Firm*—Baldwin, Egan, Walling & Fetzer

[57] ABSTRACT

A suspension clip for assembly with a beam support having a base flange, such as for instance an inverted T-beam. The clip is formed of resilient sheet material and comprises a generally flat body and reversely bent arms extending generally parallel to the body on the same side of the latter, from opposite edges of the body, with each arm including a generally upstanding tab extending generally perpendicular to the plane of the body. The clip is adapted to be placed against the underside of the base flange of the support beam, and rotated to cause the body and coacting arms to resiliently grasp the base flange. The body may have dependent structure for attaching an article to the beam-clip assembly.

20 Claims, 8 Drawing Figures

ROTATABLY INSTALLED SUSPENSION CLIP

This invention relates in general to a suspension clip, and more particularly to a suspension clip which is adapted for rotatable installation onto a beam support having a base flange, such as for instance an inverted T-beam.

BACKGROUND OF THE INVENTION

There are many types of suspension clips known in the art for assembly with beam structures for use such as for instance in suspended ceiling structures, for mounting or suspending articles from the beam structure. U.S. Pat. Nos. 555,981 to Streeter; 1,094,496 to Tuite; 3,003,735 to Havener; 3,018,080 to Loudon; 3,181,830 to Newbold, and 3,276,800 to Loudon et al, disclose various arrangements of beam clips for attachment to beam structure. These prior art clips have various failings however, such as for instance, being difficult to assemble with the beam, or not being able to positively maintain their position on the beam when assembled therewith, or being unduly expensive to manufacture.

SUMMARY OF THE INVENTION

The present invention provides a novel clip adapted for assembly with a beam having a base flange, such as for instance an inverted T-beam, and which is adapted for rotatable assembly with the beam support, and wherein the clip embodies structure for facilitating the movement of the clip into assembled coaction with the beam support, and for maintaining such assembled coaction of the clip with the beam.

Accordingly, an object of the invention is to provide a novel clip for assembly with a beam support having a base flange, such as for instance an inverted T-beam.

Another object of the invention is to provide a clip adapted for expeditious assembly with a beam support, and which includes means for suspending an article from the clip in its mounted relation to the beam.

Another object of the invention is to provide a clip of the aforementioned type which includes tab means thereon useable for facilitating the rotary installation of the clip onto the beam support.

A still further object of the invention is to provide a clip of the aforementioned type wherein the tab means facilitates the retention and stability of the clip in positioned relationship on the beam support.

Another object of the invention is to provide a clip of the aforementioned type which may be formed from flat sheet-like material such as sheet metal, utilizing mass production precedures.

Other objects and advantages of the invention will be apparent from the following description taken in conjunction with the accompanying drawings wherein:

DESCRIPTION OF PREFERRED EMBODIMENTS

The clip is preferably formed of sheet-like material having resilient or spring characteristics, such as for instance sheet metal (e.g. spring steel) or some similar material which has spring or resilient characteristics.

Figure 1:
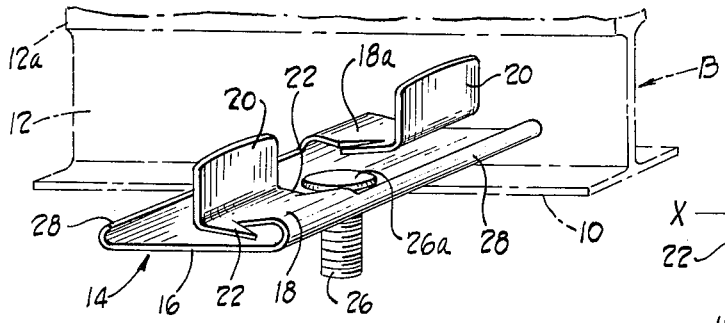
FIG. 1 is a generally perspective illustration of a clip embodying the invention, showing in phantom lines a beam support to which the clip is adapted for mounting by rotation of the clip relative to the base flange of the support beam.
Figure 5:
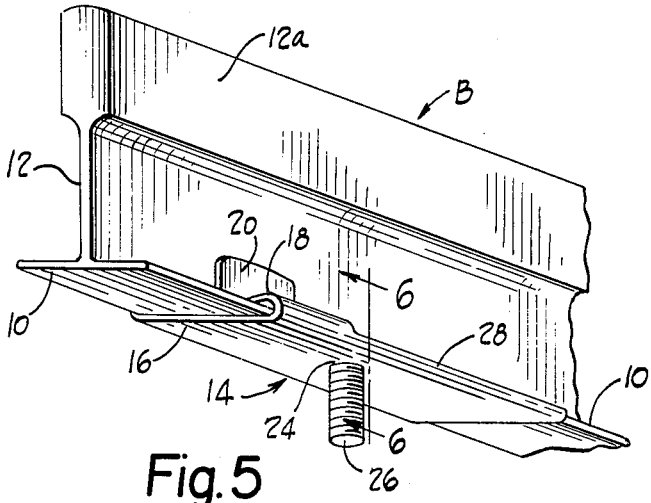
FIG. 5 is a generally perspective view of the clip of FIGS. 1–4 as mounted in assembled relation on the beam support.

The clip is adapted for assembly on a beam support having a base flange such as for instance the inverted T-beam B illustrated in phantom lines in FIG. 1 and in full lines in FIG. 5. The beam B comprises a base flange 10, a central web 12 and in the embodiment illustrated, an enlarged head portion 12*a*.

Figure 4:
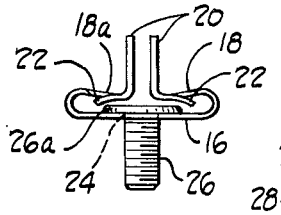
FIG. 4 is an end elevational view of the FIGS. 1, 2 and 3 clip.

The clip 14 comprises a generally flat body portion 16 including reversely bent arm portions 18, 18*a*, disposed adjacent opposite side edges of the body portion and generally adjacent the ends thereof. The arm portions 18, 18*a* are disposed generally parallel to but preferably slightly oblique to the plane of the body portion 16 in the non-assembled condition of the clip, and as can be best seen in FIGS. 1 and 4. The arm portions extend inwardly from the edges of the body portion, onto the same side thereof.

Each arm portion preferably includes a tab portion 20 extending generally perpendicular to the plane of the body portion. The arm portions preferably have a partially severed sections 22 which are bent out of the plane of the respective arm portion so as to form a generally pointed barb, extending diagonally in the direction of the body portion 16, for gripping the base flange on the support beam when the clip is mounted on its associated beam, and prevent inadvertent reverse rotary movement or disassembly of the clip from the beam after installation on the latter. In the embodiment illustrated, barbs are preferably provided on both lateral sides of the respective arm portion.

The body portion is provided with means thereon for securing an associated member or part to the clip. In the embodiment illustrated in FIGS. 1–6, this means comprises an opening 24 formed in the clip body, and through which is received a threaded headed fastener or stud 26 which depends from the clip body, with the head 26*a* of the fastener preferably being secured as by spot welds 26*b* or any other suitable means, to the body of the clip proper, so that the fastener and the clip will be maintained in assembly as a unit, with the fastener 26 being preferably nonrotatable about its lengthwise axis, with respect to the clip body portion.

Figure 2:
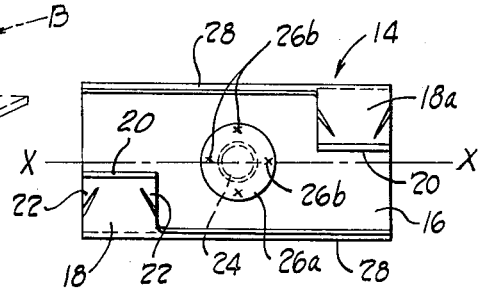
FIG. 2 is a top plan view of the FIG. 1 clip.

When the clip is in mounted relation on a beam support, the fastener projects downwardly from the beam and can be utilized in attaching an associated article (not shown) to the beam support and clip assembly. As best seen in FIG. 2, the axis of opening 24 (and associated fastener 26) preferably passes through lengthwise axis X—X of the body portion.

Figure 6:
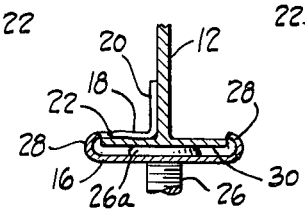
FIG. 6 is a fragmentary, sectional view taken generally along the plane of line 6—6 of FIG. 5, looking in the direction of the arrows.
Figure 3:
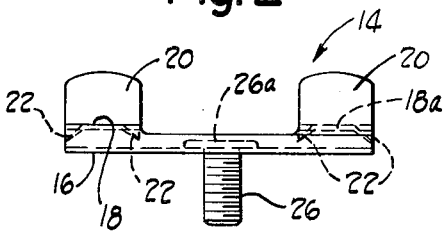
FIG. 3 is a side elevational view of the clip of FIGS. 1 and 2.

Referring now again to FIGS. 1 and 6, the clip is preferably assembled on the beam support by placing the clip against the underside of the base flange portion of the beam in generally angled relation thereto as illustrated in FIG. 1, and then rotating the clip as by means of the tab portions 20, and in the direction of the full line arrows in FIG. 1, to cause the body portion and coacting arm portions to embrace the base flange of the associated support beam. The aforementioned barbs 22 prevent inadvertent counter-rotational removal of the clip from the beam, due to the resiliency of the arm portions, causing the barbs to grip or embed into the beam upon any such counter-rotational movement. Referring now particularly to FIG. 6, it will be seen that the tab portions in the assembled condition of the clip are disposed closely adjacent to or engaged with the central web 12 of the associated support beam B, and aid in stabilizing the clip on the beam.

Each side edge of the clip body is bent upwardly into an arcuate flange curvature 28, as best illustrated in FIGS. 1 and 6, so that when the clip is rotated into assembled relationship with the associated support beam, these arcuate flange edges encompass the corresponding edges of the base flange of the beam, and aid in preventing inadvertent removal of the clip from the beam. As can be seen in FIG. 1, these flanged edges 28 preferably extend for the full length of the body portion from the corresponding end thereof up to the associated arm portion on the respective side of the clip body portion. Since the arm portions are resilient, the latter accommodates for movement of the clip during its rotational assembly with the associated support beam, and the snapping of the flanged edges of the clip body into coacting encompassing relationship with the corresponding edges of the support beam. In the assembled condition of the clip with the associated support beam as illustrated for instance in FIG. 5, the clip is securely assembled to the beam in stationary relation. As can be best seen in FIG. 6, the enlarged head portion **26*a* of the threaded stud 26 spaces the body portion 16 of the clip a slight amount from the underside surface of the support beam as at 30 in the assembled condition of the clip to the beam, thus drawing the arm portions 18, 18*a* down against the top surface of the base flange of the support beam, and insuring good engagement of the barbs 22 with the top surface of the support beam. The threaded stud extends downwardly from the underside of the clip and can be utilized to attach an article thereto in conjunction with a threaded nut or sheet metal fastener (not shown). To intentionally remove an assembled clip, a tool, such as a screwdriver, may be inserted under each arm portion to disengage the barbs 22** and permit counterrotation of the clip to disassembled condition.

Figure 7:
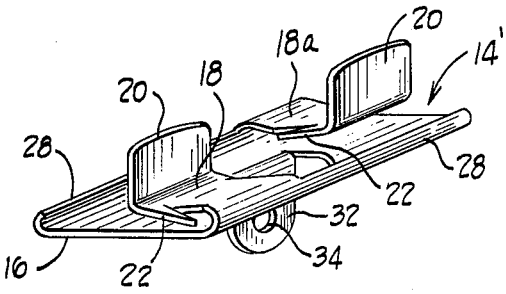
FIG. 7 is a perspective view illustrating a modified form of the FIGS. 1–6 clip.

Referring now to FIG. 7, there is shown a modified embodiment 14' of the clip. In this embodiment, a section 32 is partially severed from the base portion of the clip, and is bent so as to depend downwardly or angularly therefrom, with such bent portion being provided with an opening 34 therein, for attachment of an article. In other respects, this clip is generally similar to that of the first described embodiment.

Figure 8:
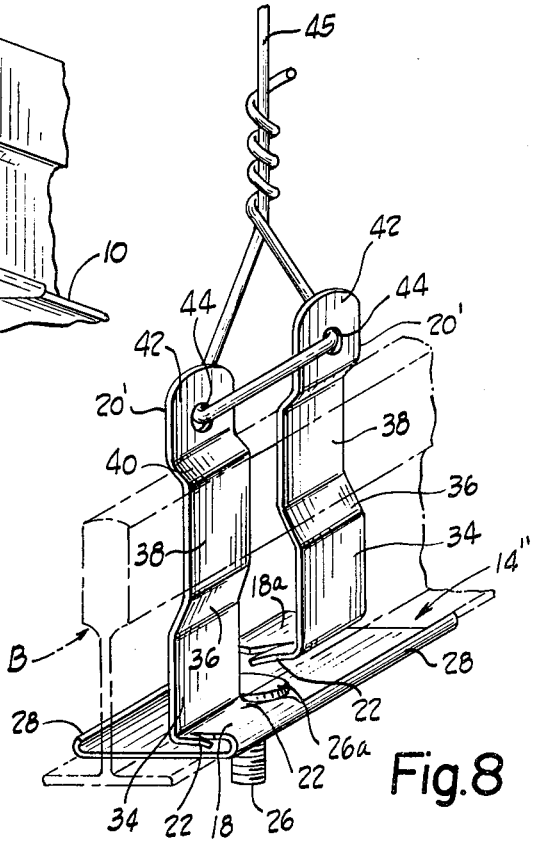
FIG. 8 is a perspective view illustrating a further modified form of clip.

Referring now to FIG. 8, there is illustrated a further embodiment 14'' of clip, wherein the tab portions 20' have been lengthened, so as to extend upwardly above the head or top of the support beam. Such tab portions 20' are each comprised of a first section 34 which is adapted to generally engage or be adjacent to the confronting side of the web portion 12 of support beam, in a generally similar manner as the tab portions 20 of the first described embodiment. Then the tab portion 20' is bent outwardly as at 36 and then generally vertically upwardly as at 38, and then back inwardly as at 40, to generally encompass the head portion **12*a* of the support beam. The distal end portion 42 of the respective tab portion 20' may be disposed generally along the longitudinal vertical center plane of the support beam. Openings 44 can be provided in the respective portion 42 as shown, for attachment of an article, such as a wire 45** thereto, for suspending the clip from above. Thus, it will be seen that the clip can actually be utilized to support the associated beam member B. In other respects, this clip may be generally similar to those of the first described embodiments.

From the foregoing discussion and accompanying drawings it will be seen that the invention provides a novel suspension clip adapted for rotatable installation on a beam support, having a base flange, such as an inverted T-beam, with the clip comprising a generally flat body portion formed from sheet-like resilient material, and including reversely bent arm portions on opposite edges of the body portion with each arm portion including a tab portion extending generally perpendicular to the plane of said body portion, and with the arm portions being adapted to embrace the base flange of the associated support beam, when the clip is placed against the underside of the beam in angled relation thereto and rotated into assembled relation with the beam support. The invention also provides a suspension clip which can be readily fabricated from sheet material, such as sheet metal, utilizing mass production procedures.

The terms and expressions which have been used, are used as terms of description, and not of limitation, and there is no intention in the use of such terms and expressions of excluding any equivalents of any of the features shown or described, or portions thereof, and it is recognized that various modifications are possible within the scope of the invention claimed.

What is claimed is:

1. A suspension clip adapted for rotatable installation on an associated support beam having a base flange such as for instance an inverted T-beam, said clip comprising a generally flat body portion formed from sheet-like generally resilient material, and having a lengthwise axis, and including reversely bent arm portions on opposite edges of said body portion, said arm portions extending generally parallel to said body portion on the same side thereof and extending toward but not through a lengthwise plane perpendicular to the plane of said body portion passing through and generally containing said axis of said body portion, and each of said arm portions including a tab portion extending generally perpendicular to said plane of said body portion, said body portion and coacting arm portions being adapted to embrace the base flange of the associated support beam when the clip is placed against the underside of the support beam in angular relation thereto and rotated to cause said body portion and coacting arm portions to resiliently grasp the base flange of the support beam.

2. A clip in accordance with claim 1 including means on said body portion for mounting support means thereto.

3. A clip in accordance with claim 1 including means on said body portion for mounting a threaded stud therethrough, the last mentioned means comprising an opening through said body portion, and a threaded stud extending through said opening, said stud having a generally flatten head portion, said head portion having a relatively small thickness such that said head portion is disposed substantially in the plane of said body portion, and projects a minimum amount upwardly above said body portion plane when said stud is disposed in depending relation to said body portion, the first mentioned plane passing generally through the axis of said opening.

4. A clip in accordance with claim 1 including upturned flanges running continuously along said edges of said body portion commencing from the respective arm portion to the opposite end of said body portion.

5. A clip in accordance with claim 1 including gripping means on each of said arm portions extending outwardly therefrom and adapted to grip the base flange of the support beam when the clip is rotated into assembled engagement therewith, each of said tab portions extending at a generally right angle from the remainder of the respective arm portion and adapted when assembled with an associated T support beam to be disposed closely adjacent to the central web of such beam.

6. A clip in accordance with claim 1 including means for supporting an article therefrom, said means comprising a partially severed section of said body portion bent out of the plane thereof into angular relationship with respect to said body portion, and including means thereon for securing an article thereto.

7. A clip in accordance with claim 1 including a partially severed section on said body portion bent out of the plane thereof into angular relationship with respect thereto, means on said partially severed section for attaching an associated article thereto, and means on said arm portions for gripping the base flange of an associated support beam when the clip is rotated into embracing assembled relationship therewith, to prevent inadvertent reverse rotation of the clip.

8. A clip in accordance with claim 1 including a threaded stud coacting with said body portion and depending therefrom.

9. A clip in accordance with claim 2 wherein said means on said body portion comprises an opening therethrough, and a threaded stud extending through said opening in assembled relation with said body portion, said stud comprising the support means for attaching an article to said clip.

10. A clip in accordance with claim 2 wherein said means on said body portion comprises an opening through said body portion adapted to receive therethrough a threaded stud, for mounting the latter on said body portion.

11. A clip in accordance with claim 5 wherein said gripping means comprises partially severed barbed sections of said arm portions projecting out the plane of the respective arm portion in a direction toward said body portion.

12. A clip in accordance with claim 4 wherein said flanges are at least in part of curved configuration in transverse section for encompassing the respective edge of the base flange of an associated support beam upon rotation of the clip into assembled relationship with respect to the base flange.

13. A suspension clip adapted for rotatable installation on an associated support beam having a base flange such as, for instance, an inverted T-beam, said clip comprising a generally flat body portion formed from sheet-like generally resilient material and including reversely bent arm portions on opposite edges of said body portion, said arm portions extending generally parallel to said body portion on the same side thereof and each including a tab portion extending generally perpendicular to the plane of said body portion, said body portion and coacting arm portions being adapted to embrace the base flange of the associated support beam when the clip is placed against the underside of the beam in angular relation thereto and rotated to cause said body portion and coacting arm portions to resiliently grasp the base flange of the support beam, and wherein each of said tab portions is of a height adapted to extend above the associated support beam, and including means on at least one of said tab portions for suspending the clip from above.

14. A clip in accordance with claim 13 wherein the last mentioned means comprises an opening therethrough adapted to receive therethrough a suspension wire for suspending the clip and an associated beam support from above.

15. A clip in accordance with claim 13 which is adapted for assembly with a beam support having a base flange, a central vertical web and an enlarged head, each of said tab portions comprising a section which extends upwardly approximately the same height as the web of the beam support, an offset section which is approximately the same height as the head of beam support, and a further upstanding section which overlies the head of such beam support, and means on the last mentioned section for suspending the clip and associated beam support from overhead.

16. In combination a support beam having a base flange and a central generally vertical web and a suspension clip mounted on the base flange, said clip comprising a generally flat body portion formed from sheet-like generally resilient material, and having a lengthwise axis, and including reversely bent arm portions on opposite edges of said body portion, said arm portions extending generally parallel to said body portion on the same side thereof, and extending toward but not through a lengthwise plane perpendicular to the plane of said body portion passing through, and generally containing the lengthwise axis of said body portion, and each of said arm portions including a tab portion extending generally perpendicular to said plane of said body portion, said body portion and coacting arm portions embracing the base flange of said support beam with the clip being assembled to the beam by placing the clip adjacent the underside of the beam in angular relation thereto and rotating the clip to cause said body portion and coacting arm portions to encompass said base flange, with said tab portions being disposed in generally adjacent relation to the center web of said support beam on opposite sides thereof.

17. The combination in accordance with claim 16 including means on at least one of said arm portions coacting in gripping relation with the base flange so as to aid in preventing inadvertent reverse rotation of the clip out of assembled relation with said support beam, said body portion having upturned flanges along said edges, said flanges being at least in part of curved configuration in transverse section and encompassing the respective edge section of said base flange in the assembled relation of said clip with said support beam.

18. The combination in accordance with claim 16 including means on said body portion depending therefrom and adapted for suspending an article from the clip when in said assembled relation with said support beam.

19. The combination in accordance with claim 16 wherein each of said tab portions is of a height extending above said web, said support beam having an enlarged head, and each of said tab portions having an offset portion receiving therein said head of said support beam in generally engaged relation, with the distal end of the respective tab portion being disposed substantially along the longitudinal vertical center plane of said support beam.

20. The combination in accordance with claim 19 including means on at least one of said tab portions for suspending the assembled clip and support beam from overhead.

* * * * *